United States Patent [19]

Leppelmeier et al.

[11] Patent Number: 4,499,403

[45] Date of Patent: Feb. 12, 1985

[54] SKIN TANNING FLUORESCENT LAMP CONSTRUCTION UTILIZING A PHOSPHOR COMBINATION

[75] Inventors: Elton T. Leppelmeier, Highland Heights; Frank I. Ewing, Cleveland Heights, both of Ohio

[73] Assignee: General Electric Company, Schenectady, N.Y.

[21] Appl. No.: 72,958

[22] Filed: Sep. 6, 1979

[51] Int. Cl.[3] ..... H01J 61/44

[52] U.S. Cl. ..... 313/487

[58] Field of Search ..... 313/487, 486; 250/504

[56] References Cited

U.S. PATENT DOCUMENTS

| | | | |
|---|---|---|---|
| 2,846,403 | 8/1978 | Hoekstra et al. | 252/301.6 |
| 3,431,215 | 3/1969 | Chenot | 252/301.4 |
| 3,670,193 | 6/1972 | Thorington et al. | 313/487 |
| 3,764,840 | 10/1973 | Shiraishi | 313/487 |
| 4,095,113 | 6/1978 | Wolff | 250/494 |
| 4,150,321 | 4/1979 | Schetters et al. | 313/486 |
| 4,194,125 | 3/1980 | Wolff | 250/504 |

*Primary Examiner*—Palmer Demeo

*Attorney, Agent, or Firm*—John F. McDevitt; Philip L. Schlamp; Fred Jacob

[57] ABSTRACT

A skin tanning lamp construction of a fluorescent type is described utilizing a combination of two different phosphor materials in order to provide a more effective sun tanning source. The particular phosphor combination can be utilized as a blended mixture having a preselected level of one phosphor component to limit the amount of erythemal radiation produced by said mixture.

4 Claims, 2 Drawing Figures

SKIN TANNING FLUORESCENT LAMP CONSTRUCTION UTILIZING A PHOSPHOR COMBINATION

BACKGROUND OF THE INVENTION

This invention relates generally to a low pressure mercury vapor discharge lamp of the fluorescent type having a particular type phosphor coating to emit skin tanning radiation when excited by the ultraviolet radiation generated from the mercury vapor discharge. More particularly, the present type lamp construction provides satisfactory skin tanning with a preselected amount of radiation in the approximate 280–320 nanometer ultraviolet region of the spectrum. The ultraviolet radiation in this region is termed UVB radiation and can produce reddening of the skin (erythema) from excessive lamp exposure such as can occur from overexposure to natural sunlight.

Lamps of the fluorescent type to produce artificial skin tanning have been known for some time. The available lamps of this type utilize a coating of a single phosphor material to emit ultraviolet radiation in the approximate wavelength region 320–400 nanometers which is commonly referred to as UVA radiation. Said available lamps produce artificial skin tanning without occasioning skin reddening (erythema) to any significant degree as can occur from overexposure to either natural sunlight or to other types of tanning lamps.

In the United States, the American Conference of Governmental Industrial Hygienists (ACGIH) has established "threshold limit" values for ultraviolet exposure in the workplace. These values are used as guides for those conditions under which it is believed that nearly all workers may be repeatedly exposed—for a nominal eight hours per day—without incurring an adverse effect to the eyes or skin. For the spectral region of the UVA (320–400 nanometers), which constitutes about 97–99% of the ultraviolet radiation emitted, the recommended irradiance or intensity limit on the eyes and skin for the full eight hours is 1,000 microwatts per square centimeter. For the spectral region in the UVC and UVB (200–280 nanometers and 280–320 nanometers, respectively) the radiant exposure upon the unprotected skin and eyes below which a threshold erythema would occur, is 3,000 microwatt seconds per square centimeter weighted in relation to its action spectrum for this effect.

It is further known, however, that UVB radiation is beneficial in promoting efficient skin tanning through formation of melanin pigment which is said to initiate the tanning process. While the exact nature of said beneficial effect is not fully understood at this time, it is known that persons already having melanin pigment present in the skin can tan effectively with UVA radiation alone. It follows from said knowledge that a skin tanning fluorescent lamp which generates both UVA and UVB radiation could thereby promote more effective artificial skin tanning in a sufficient quantity to initiate melanin production. In providing such a lamp, however, there is understandable further need to adhere to the above recommended exposure guidelines so that undesirable erythemal effects are not occasioned.

It is an important object of the present invention, therefore, to provide an improved skin tanning fluorescent lamp which generates both UVA and UVB radiation at a level which enhances artificial skin tanning while minimizing the undesirable erythemal effects.

It is still another important object of the invention to provide an improved skin tanning fluorescent lamp which achieves the desired objectives simply through modification of the coating which produces the desired source of ultraviolet radiation.

These and other important objects of the present invention together with advantages thereof may best be understood by reference to the detailed description which follows taken in connection with the included drawings.

SUMMARY OF THE INVENTION

It has now been discovered that a particular combination of two different phosphor materials provides improved skin tanning by a fluorescent lamp during exposure thereto in the order of approximately 15–30 minutes. More particularly, it has been found that a combination of a first phosphor emitting in the 320–400 nanometer region of the spectrum with a second phosphor emitting in the 280–320 nanometer region of the spectrum produces more effective skin tanning radiation than is obtained with the single phosphor material now employed in conventional skin tanning fluorescent lamps. In the preferred embodiments, a mixture of two phosphors generating the desired composite radiation wherein the proportions of the phosphor component emitting UVB radiation is maintained at a level to satisfy the ACGIH guidelines upon said radiation. Additionally, the UVA radiation from the composite emission produced with the present improved lamps also satisfies the remaining ACGIH guidelines above given again during the desired exposure period ranging between about 15–30 minutes.

Both of the individual phosphor materials utilized in the present phosphor combination are already known. A preferred phosphor material which efficiently generates the desired UVB radiation is a lead-activated barium zinc silicate phosphor such as $BaZn_2Si_2O_7$:Pb which is disclosed in U.S. Pat. No. 2,846,403, issued to Hoekstra and Klasens. Another suitable phosphor material generating the desired UVB radiation efficiently is ceriumactivated strontium aluminate such as described in Example 12 of U.S. Pat. No. 4,150,321. A suitable phosphor material efficiently generating UVA radiation is europium-activated strontium borate. Said phosphor material is also known and commercially available to include halide modifications thereof such as disclosed in U.S. Pat. No. 3,431,215.

As can be understood, the relative proportions of the individual phosphor constituents above illustrated depend upon emission efficiency of the individual phosphor materials selected and other considerations so that composite emission from the improved lamp produces more effective skin tanning while avoiding undesired erythemal effects. An especially preferred combination achieved with the above illustrated phosphor materials and which achieves said objectives is provided in a conventional fluorescent lamp construction with a two-component phosphor blend. Said phosphor mixture utilizes approximately 4–16% by weight of the lead-activated barium zinc silicate phosphor with approximately 84–96% by weight of the europium-activated strontium borate phosphor to serve as the coating in said lamp. Since the transparent envelope material of said conventional lamp construction is soda lime glass which absorbs a material portion of the desired ultraviolet radiation, any substitution of the envelope material which absorbs less or more ultraviolet radiation would understandably vary the proportions of phosphors in the preferred phosphor mixtures to meet the desired objectives.

DESCRIPTION OF THE PREFERRED EMBODIMENTS

Figure 1:
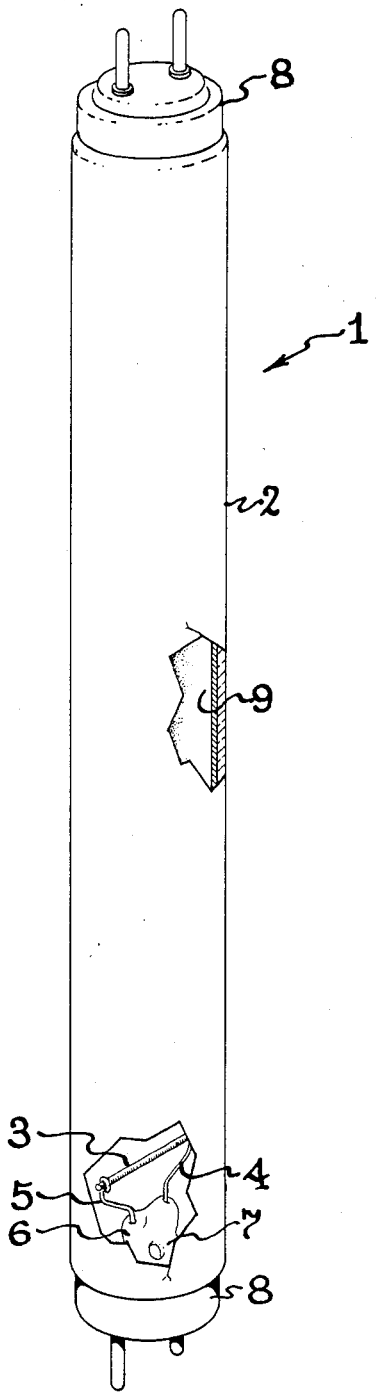
FIG. 1 is a perspective view partially broken away of a fluorescent lamp construction in accordance with the present invention.

Referring to FIG. 1, there is shown a fluorescent lamp 1 comprising an elongated soda lime silicate glass bulb 2 with circular cross section. The discharge assembly in said lamp is the usual electrode structure 3 at each end supported by inlead wires 4 and 5 which extend to a glass seal 6 in a stem mount 7 to the contacts of a base 8 affixed at opposite ends of the lamp. The discharge sustaining filling in the sealed glass tube is an inert gas such as argon or a mixture of argon and other gases at a low pressure in combination with a small quantity of mercury to provide the low vapor pressure manner of lamp operation. The inner surface of the glass bulb is provided with a phosphor coating 9 which is applied extending substantially the full length of the bulb and around the bulb circumferential inner wall.

Figure 2:
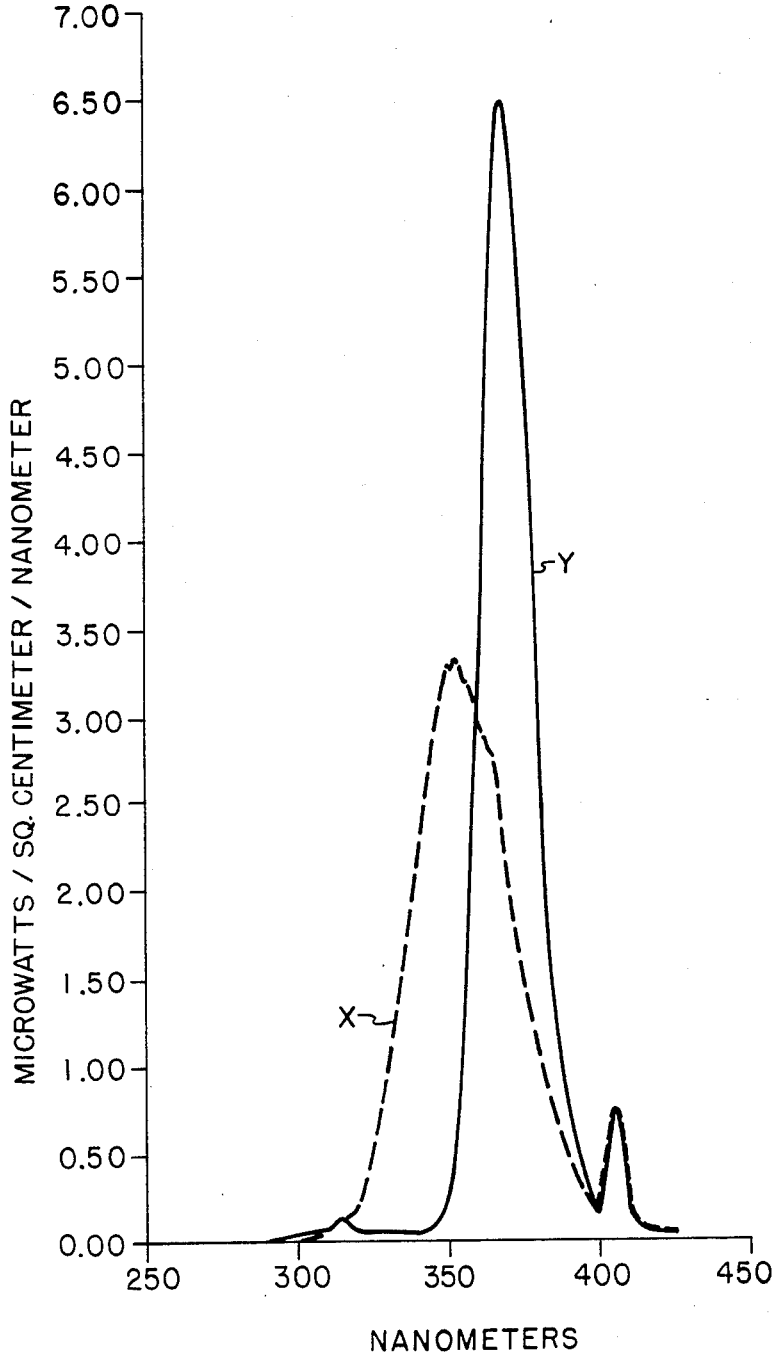
FIG. 2 is a graph depicting emission curves obtained with fluorescent lamps having the lamp construction described in FIG. 1 with different phosphor coatings that illustrate the improvement obtained in accordance with the present invention.

To better illustrate the improvement obtained in emission behavior for the above type lamp construction utilizing the present lamp phosphor combination as a blended mixture, various conventional F72T12/BL/HO lamps were constructed for operation at approximately 117 volts and 0.800 amps of applied electrical energy. Said lamps were coated in the conventional manner with either a lead-activated barium disilicate phosphor alone or phosphor coatings in accordance with the present invention to permit a comparison therebetween. Operation of these fluorescent lamps produced the emission curves depicted in FIG. 2 with Curve X representing the already known barium disilicate coating whereas Curve Y represents the emission curve produced with the coating having approximately 8% by weight of said lead-activated barium zinc silicate mixed with 92% by weight europium-activated strontium borate. Said emission curves were measured after approximately 100-hour burning time for both type lamps and clearly demonstrate increased UVB and UVA radiation for the present phosphor combination as compared with the conventional single phosphor material.

To further illustrate the manner in which the relative proportions of each phosphor material in the preferred phosphor mixtures dictate the exposure time period for conformity with the ACGIH recommended guidelines, further test results are reported in Table I below:

TABLE I

| UVB Phosphor (BY WEIGHT) | Total Lamp Emission (280–320 nanometers) (MILLIWATTS) | Exposure Time Minutes for Threshold Erythema at 5 Centimeters |
|---|---|---|
| 4 | 105 | 40 |
| 8 | 190 | 30 |
| 10 | 220 | 25 |
| 12 | 255 | 20 |
| 16 | 340 | 10 |

As can be noted from the above Table I, the lamp emission in the UVB region (280–320 nanometers) understandably increases with an increased proportion of the lead-activated barium zinc silicate phosphor component in the mixture. The exposure time periods reported in said Table I can be understood by providing the basis by which these values were established. In computing said time period values, the irradiance in the spectral region of 280–320 nanometers were obtained radiometrically at a distance of 50 centimeters from the lamp center. These were weighted with relation to the ACGIH action spectrum for threshold erythema and divided into the permissible exposure guidelines of 3,000 microwatt seconds per square centimeter. Time for this effect at 5 centimeters was calculated on an inverse distance relationship. From the above it follows that the UVB phosphor content in said phosphor combination should be maintained in the 8–10% range by weight if an exposure period in the range of 25–30 minutes is desired for said lamps.

From the above preferred embodiments, it is also evident that a particular two-component phosphor combination has been provided which achieves more effective artificial skin tanning from the presence of a UVB phosphor component in the lamp coating with minimum risk of overexposure to undesired erythemal effects. It will also be apparent, however, that some modification can be made in the illustrated embodiments through compositional variation of the individual phosphor constituents selected without departing from the true spirit and scope of this invention. Consequently, it is intended to limit the present invention only by the scope of the following claims.

What we claim as new and desire to secure by Letters Patent of the United States is:

1. An improved skin tanning fluorescent lamp having a sealed transparent envelope enclosing means to generate a low pressure mercury discharge within said envelope, and a coating contained within said envelope for conversion of at least a portion of the radiation emitted from said discharge to skin tanning radiation, the improved coating comprising a physical mixture consisting essentially of a first phosphor emitting in the 320–400 nanometer region of the spectrum and a second phosphor emitting in the 280–320 nanometer region of the spectrum, so that principal lamp emission resides in said 320–400 nanometer region, wherein the second phosphor is approximately 4–16% by weight of said coating.

2. The improved coating of claim 1 wherein the second phosphor is a lead-activated barium zinc silicate phosphor.

3. The improved coating of claim 1 wherein the first phosphor is a divalent europium-activated strontium borate phosphor

4. The improved coating of claim 1 wherein the improved coating is a physical mixture of a lead-activated barium zinc silicate phosphor and a divalent europium-activated strontium borate phosphor.

* * * * *